US007178580B2

(12) United States Patent
Faure et al.

(10) Patent No.: US 7,178,580 B2
(45) Date of Patent: Feb. 20, 2007

(54) HEAT EXCHANGER FOR A MOTOR VEHICLE

(75) Inventors: Lionel Faure, Sarreguemines (FR); Hubert Kihn, Hoste (FR)

(73) Assignee: Behr Lorraine S.A.R.L., Cedex (FR)

( * ) Notice: Subject to any disclaimer, the term of this patent is extended or adjusted under 35 U.S.C. 154(b) by 0 days.

(21) Appl. No.: 11/108,897

(22) Filed: Apr. 19, 2005

(65) Prior Publication Data

US 2005/0236141 A1 Oct. 27, 2005

(30) Foreign Application Priority Data

Apr. 19, 2004 (EP) ..... 04291031

(51) Int. Cl.
*F28F 9/007* (2006.01)

(52) U.S. Cl. ..... 165/67; 165/178; 180/68.4

(58) Field of Classification Search ..... 165/67, 165/149, 178; 180/68.4
See application file for complete search history.

(56) References Cited

U.S. PATENT DOCUMENTS 5,205,349 A 4/1993 Nagao et al.
5,509,473 A 4/1996 Tokutake
6,123,143 A * 9/2000 Insalaco ..... 165/67
6,446,711 B1 * 9/2002 DeGroot et al. ..... 165/149

FOREIGN PATENT DOCUMENTS

| | | | | |
|---|---|---|---|---|
| DE | 42 17 062 A1 | | 11/1992 | |
| EP | 0 617 251 A2 | | 9/1994 | |
| FR | 2 791 766 A1 | | 10/2000 | |
| JP | 03070994 A | * | 3/1991 | ..... 165/67 |
| JP | 05332693 A | * | 12/1993 | ..... 165/178 |
| WO | WO 2004/0065884 A1 | | 8/2004 | |

* cited by examiner

*Primary Examiner*—Leonard R. Leo
(74) *Attorney, Agent, or Firm*—Foley & Lardner LLP

(57) ABSTRACT

A brazed heat exchanger (1) suitable for a motor vehicle comprises at least one manifold (3), to which at least one additional part (5) is fastened. The at least one additional part (5) has a fork-shaped profile piece (12), which is adapted to the circumference of the manifold (3), lies against the circumference of the manifold (3) and can be fixed thereto by a form locking and/or frictional connection, preferably prior to brazing.

14 Claims, 4 Drawing Sheets

HEAT EXCHANGER FOR A MOTOR VEHICLE

CROSS-REFERENCE TO RELATED PATENT APPLICATIONS

The right of priority under 35 U.S.C. §119(a) is claimed based on European Patent Application 04 291 031.5, filed Apr. 19, 2004, the entire disclosure of which, including the specification, drawings, claims and abstract, is incorporated herein by reference. Commonly assigned related International Application No. PCT/EP2004/000560 (published as WO 2004/065884) is also incorporated by reference in its entirety.

BACKGROUND OF THE INVENTION

The invention relates to a brazed heat exchanger having at least one manifold, to which an additional part is fastened, in particular for use in the type of connection shown according to the subject matter of the commonly assigned earlier patent application WO 2004/065884. The invention also relates to a method for mounting a heat exchanger in a motor vehicle and to a motor vehicle so equipped.

In the aforementioned commonly assigned earlier patent application there is disclosed a brazed heat exchanger which is formed, in a preferred embodiment, as a condenser of an air-conditioning system for a motor vehicle. It includes at least one refrigerant connector for connection to a refrigerant circuit and holders or brackets for the mounting of the condenser. The connector and the holders are additional parts which are fastened to at least one manifold of the condenser by brazing. Before the brazing process, all the parts are positioned and fixed, in order that they retain their predetermined position during the brazing process. Various solutions for fixing the parts are proposed in the earlier application, including a form locking between the additional parts and the manifold, or slots in the manifold in which fixing elements fastened to the additional part engage. Although the brazing gaps produced as a result between the manifold and the additional parts are closed during the brazing, which preferably takes place by the so-called Nocolok process, there is the risk that leaks or the formation of weak points may occur due to an inhomogeneous microstructure of the soldered joint. Since condensers for motor vehicles are subjected to particularly strong vibrational stress, the connection in particular between the holder and the manifold should be formed with adequate long-term strength and stability.

SUMMARY OF THE INVENTION

It is therefore one object of the present invention to provide an improved heat exchanger employing an improved connecting technique between additional parts and the manifold for a heat exchanger.

A further object is to provide a heat exchanger having a permanent, vibration-resistant brazed connection which minimizes leakages or strength problems.

In accordance with one aspect of the invention, there has been provided a heat exchanger suitable for use in a motor vehicle, comprising: at least one manifold; and at least one additional part fastened to the at least one manifold, the at least one additional part having a fork-shaped profile piece, which has a size and configuration with respect to the circumference of the manifold, such that the profile piece lies against the circumference of the manifold and can be fixed thereto by a form locking and frictional connection.

In accordance with another aspect of the invention, there has been provided a motor vehicle comprising at least one heat exchanger, wherein the heat exchanger is a heat exchanger as described above.

In accordance with still another aspect of the invention, there has been provided a method for mounting a heat exchanger in a motor vehicle, comprising applying to at least one manifold of a heat exchanger at least one mounting part comprising a fork-shaped profile piece, which has a size and configuration with respect to the circumference of the manifold such that the profile piece lies against the circumference of the manifold and can be fixed thereto by a form locking and frictional connection to form a preliminary assembly; and subsequently subjecting the preliminary assembly to a brazing operation to braze together the at least one mounting part and the at least one manifold.

Further objects, features and advantages of the present invention will become apparent from the detailed description of preferred embodiments that follows, when considered together with the accompanying figures of drawing.

DETAILED DESCRIPTION OF THE PREFERRED EMBODIMENTS

Figure 1:
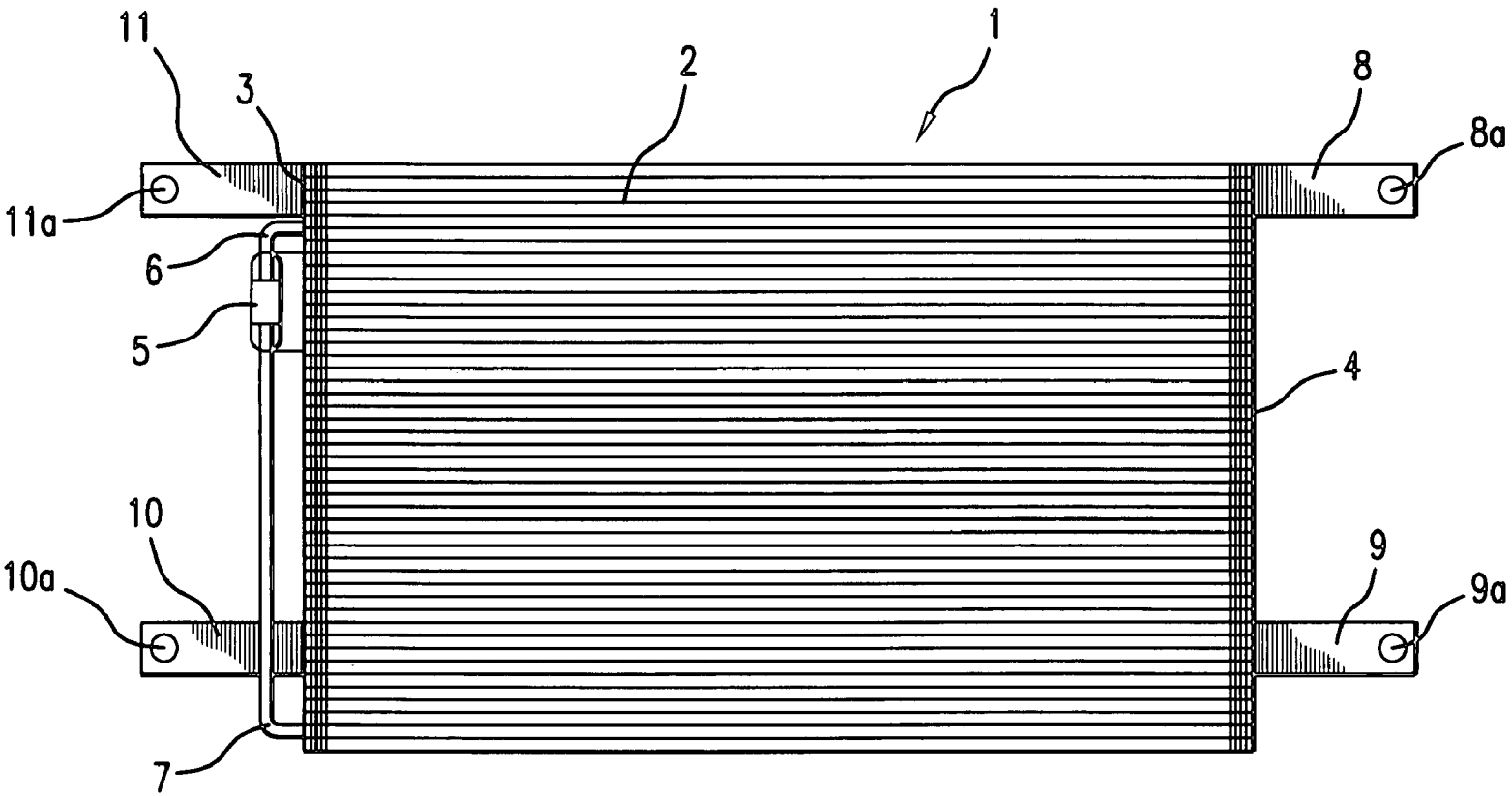
FIG. 1 is a plan view showing a condenser for an air-conditioning system for a motor vehicle, with four holders and a refrigerant connector.

According to the invention, a frictional connection is provided—in addition to the form locking—between the additional part and the manifold. The additional part has a fork-shaped profile piece, which comes to lie against the circumference of the manifold with a form locking before the brazing process, and is positioned on the manifold in such a way that a clamping fit is established between the fork-shaped profile piece and the circumference of the manifold. This clamping fit produces a frictional connection, which ensures adequate fixing of the additional part on the manifold, in particular for a brazing process. This achieves the advantage that the manifold remains closed in its surface, that is to say it has no slots, and, if applicable, a brazing device which keeps the additional part and the manifold in position during brazing is superfluous. The fixing according to the invention by means of a clamping fit also advantageously facilitates a sealed, homogeneous and permanently strong brazed connection between the additional part and the manifold, which is also suitable for withstanding the vibrational stresses occurring in particular in the motor vehicle.

In a preferred embodiment of the invention, the fork-shaped profile piece has two legs, which clasp the manifold with elastic pretensioning. This elastic pretensioning can be advantageously established by an undersize of the width of the fork with respect to the outside diameter of the manifold, whereby the distance between the legs is increased when it is pushed onto the manifold by a suitable device and the legs spring back after it has been pushed on. After that, the additional part fits securely on the manifold and is fixed.

In a further preferred embodiment of the invention, the profile piece grips with its legs around the manifold up to a circumferential angle of at least about 180°, preferably up to about 210°. As a result, the advantage of a further-reaching form locking, preferably of a latching engagement, is achieved between the profile piece and the manifold.

In a preferred embodiment of the invention, the profile piece preferably has on its inner side a U-profile, which is made up of an arc and two straight legs adjoining the arc. The manifold has a similar cross-sectional geometry, so that surface pressure is obtained between the legs and the corresponding circumferential regions of the manifold on account of the elastic pretensioning. In this way, the advantage of a uniform brazing gap is also obtained, i.e., a prerequisite for satisfactory brazing.

In a further preferred embodiment of the invention, the manifold may be formed in one or two pieces, for example, as a welded tube or composed of a base part and a cover part which are brazed or otherwise attached to each other lengthwise. As a result, offsets are formed on the longitudinal sides by the upper edges of the base part.

According to a preferred embodiment of the invention, offsets which engage in the offsets of the two-piece manifold are provided on the inner surface of the profile piece, e.g., preferably at the transition from the arc to the planar flanks. This achieves the added advantage of a stop when the profile piece is fitted on.

In a further preferred embodiment of the invention, the heat exchanger is formed as a condenser of an air-conditioning system for a motor vehicle. In this case, the additional parts are formed as a refrigerant connector and one or more holders by which the condenser is suspended or mounted in the motor vehicle, preferably on a neighboring heat exchanger, usually the coolant radiator. Advantageously, both the connector and the holder(s) are formed as extruded parts which respectively have the same extruded profile piece for enclosing the manifold.

In a preferred embodiment of the invention, the condenser is brazed to its additional parts "in one shot", i.e., in one operation in the brazing furnace, in such a way that a brazing device is not needed. The additional parts include, on the one hand, one or two refrigerant connectors (double connector or two single connectors) and one or more holders, preferably four. In addition, refrigerant connection pipes, which lead from the refrigerant connector into the manifold concerned, are also brazed. In this case, the refrigerant connector serves as fixing for the connection pipes.

Turning now to the drawings, FIG. 1 shows a condenser 1 of an air-conditioning system (not shown in greater detail) of a motor vehicle. The condenser 1 comprises a network or block 2, which is preferably composed of flat tubes and corrugated fins (not represented in any more detail). Preferably arranged on both sides of the block 2 are manifolds 3, 4, which communicate with the flat tubes of the block 2. Fastened to the manifold 3 arranged on the left in the drawing is a connector 5, from which refrigerant connection pipes 6, 7 lead into the manifold 3. The condenser 1 is connected by means of the refrigerant connector 5 to a refrigerant circuit (not shown in detail) of the air-conditioning system. The condenser 1 also has four holders 8, 9, 10, 11, two of which in each case are respectively fastened to the manifolds 3 and 4. By means of the holders 8, 9, 10, 11, which respectively have fastening bores 8*a*, 9*a*, 10*a*, 11*a*, the condenser is suspended or mounted in the motor vehicle, preferably on a neighboring heat exchanger, for example, a coolant radiator (not shown in detail). The block 2 of the condenser 1 is traversed by ambient air, to which the refrigerant gives off its heat of condensation.

Figure 2:
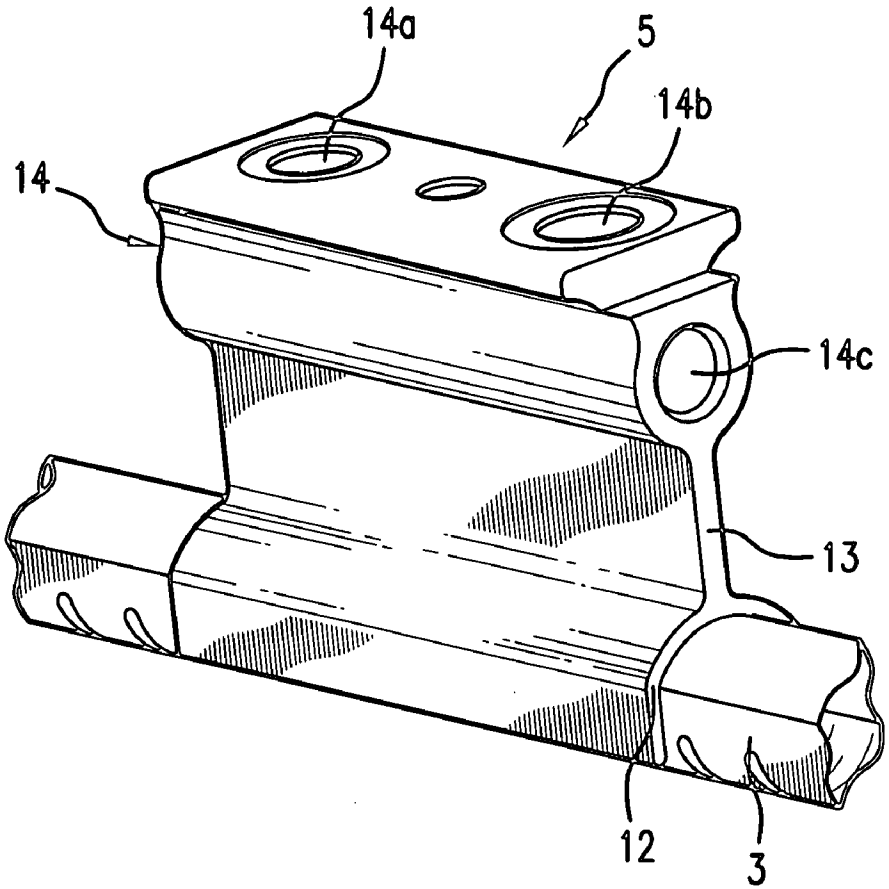
FIG. 2 is a perspective view showing the refrigerant flange on a manifold of the condenser.

FIG. 2 shows a preferred refrigerant connector 5 in a perspective representation on the manifold 3, which is only partially represented. The connector 5 is preferably an extruded part which has a fork-shaped profile piece 12, a web 13 and a refrigerant connection region 14 with refrigerant connection bores 14*a*, 14*b*, 14*c* (a further bore is concealed opposite bore 14*c*). The connector 5 is fastened on the manifold 3 by brazing.

Figure 3:
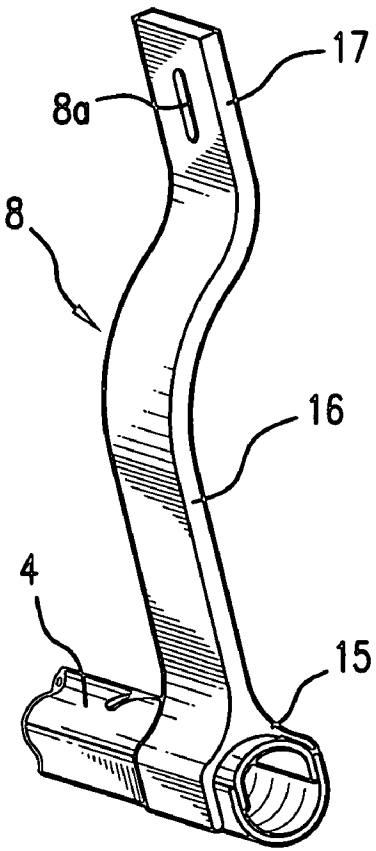
FIG. 3 is a perspective view showing one of the holders on a manifold of the condenser.

FIG. 3 shows the holder 8 (by way of example of the other holders 9, 10, 11), which is likewise preferably produced as an extruded part from an aluminum extrusion alloy. The holder 8 comprises a fork-shaped profile piece 15, which partially encloses the manifold 4, a bent web 16 and a fastening piece 17 with a fastening bore 8*a*. The holder 8 is brazed to the manifold 4 by means of the profile piece 15.

Figure 4:
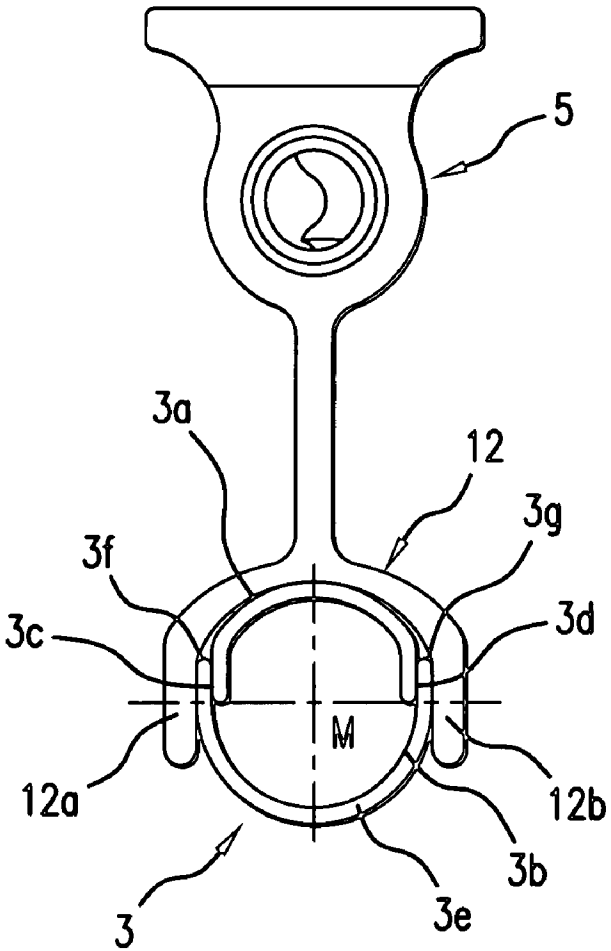
FIG. 4 is a cross-sectional view showing the refrigerant flange on the manifold.

FIG. 4 shows the connector 5 (according to FIG. 2) in a sectioned representation (without hatching). For this embodiment, the manifold 3 is formed in two pieces, i.e., it has a cover part 3*a*, which is inserted in a base part 3*b* of a larger diameter and with the latter forms lateral overlapping zones 3*c*, 3*d*, by means of which the cover 3*a* and the base 3*b* are brazed to each other. The base 3*b* has a plurality of passages (transversely running slots) 3*e*, into which the tube ends (not represented) of the flat tubes are inserted and brazed. The base 3*b* is delimited in the upward direction by upper edges 3*f*, 3*g*, which, with the cover 3*a*, form offsets on the outer side. The fork-shaped profile piece 12 has two legs 12*a*, 12*b* arranged parallel to each other, which enclose the manifold 3 in the region of the overlapping zones 3*c*, 3*d*. The legs 12*a*, 12*b* are extended significantly beyond the overlapping zones 3*c*, 3*d*, so that the profile piece 12 encloses significantly more than half the circumference of the manifold 3. For the purpose of illustration, the center point M of a circle with the diameter of the half-shell-shaped base 3*b* and four quadrants of the circle are depicted in the manifold 3.

Figure 5:
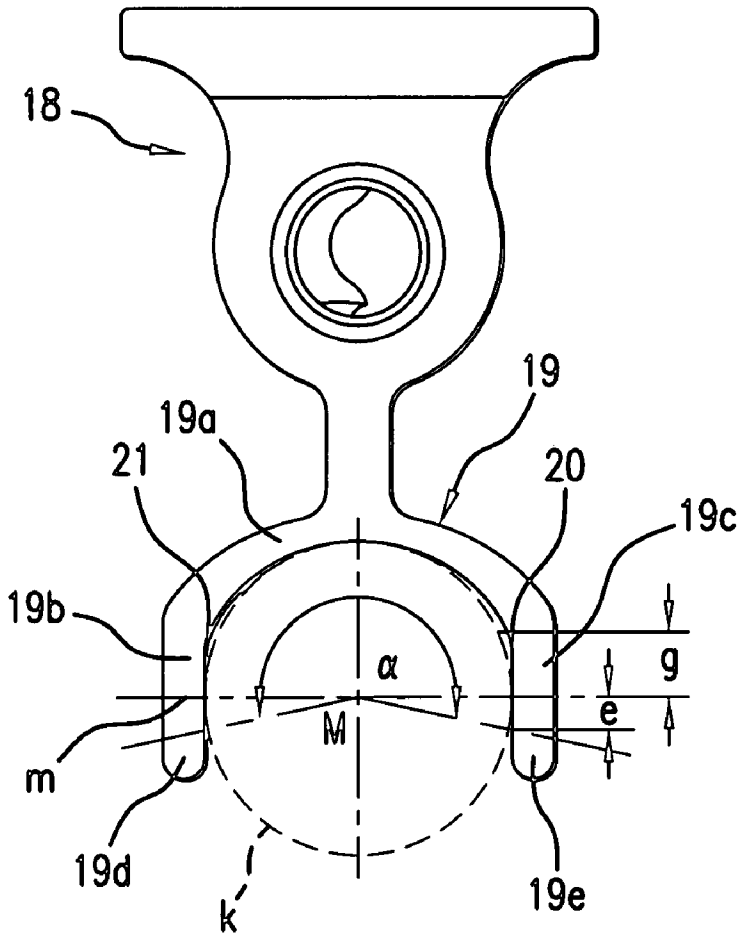
FIG. 5 is a view similar to FIG. 4 showing the refrigerant flange in a modified embodiment.

FIG. 5 shows a modified embodiment of a holder 18 with a modified profile piece 19, which is likewise formed in a fork-shaped manner and comprises an arcuate piece 19*a* and two legs 19*b*, 19*c*, which are substantially parallel to each other and adjoin said arcuate piece. On the inner side of the profile piece 19, offsets 20, 21 are arranged in the region of the transition of the arcuate piece 19*a* to the lateral legs 19*b*, 19*c*. A circle k, represented by dashed lines and with a center point M, is inscribed in the fork-shaped profile piece 19, the circle k corresponding approximately to the circumference of the manifold 3 (cf. FIG. 4). The offsets 20, 21 are therefore arranged significantly above the center point M; they serve during the assembly of the profile piece 19 as a stop with respect to the upper edges 3*f*, 3*g* of the base 3*b* of the manifold 3 (cf. FIG. 4). Placed through the center point M is a center line m, which is horizontal in the drawing and is at a distance g from the offsets 20, 21. In this region g, the legs 19*b*, 19*c* are straight on the inner side and aligned substantially parallel to each other. Beneath the center line m there adjoin converging arcuate pieces to a distance e. The free ends of the legs 19*b*, 19*c* are formed as lips 19*d*, 19*e* facing inwardly (in the direction of the center point M). In this way they enclose the manifold represented by the circle k with a circumferential angle α of significantly more than 180°, i.e. approximately 210°.

Figure 6:
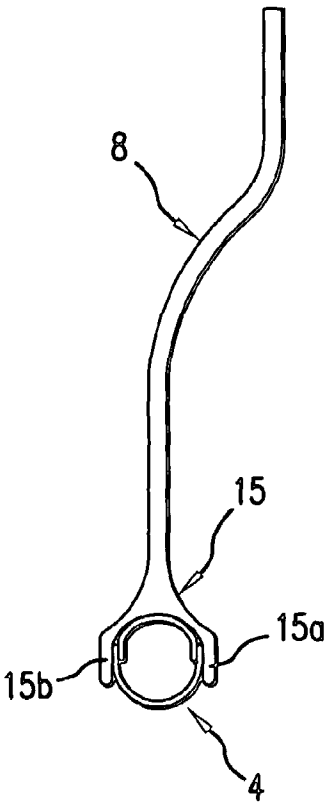
FIG. 6 is a cross-sectional view showing the holder on the manifold.

FIG. 6 shows the holder 8 (according to FIG. 3) in another representation, namely, in a cross-section through the manifold 4, which is formed in two pieces. The profile piece 15 for the holder 8 corresponds in principle to the profile piece 12 for the connector 5 (cf. FIG. 4).

Figure 7:
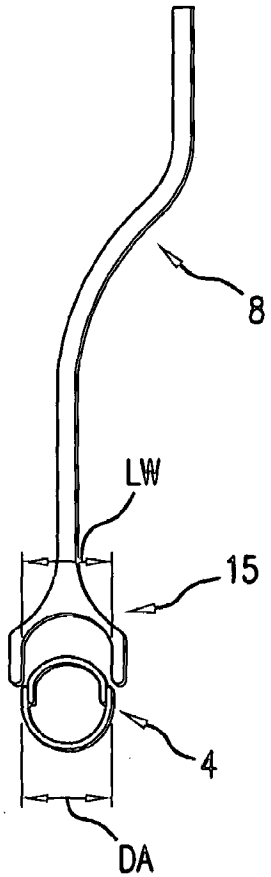
FIG. 7 is a schematic view showing the holder and the manifold prior to assembly.

FIG. 7 shows the holder 8 with the profile piece 15 and the two-piece manifold 4 prior to assembly. The manifold 4 is in this case located in a device (not shown in detail), and the holder 8 is fitted with its profile piece 15 on the manifold 4 in such a way that subsequently a clamping fit or press fit is obtained. In order to achieve this, the profile piece 15 has a clear width LW, and the manifold 4 has an outside diameter DA, where LW≦DA. The profile fork 15 consequently has an undersize with respect to the outside diameter DA, or the latter has an oversize with respect to the width of the profile fork. The difference or the oversize can preferably amount to DA−LW=0.1 mm. For assembly, the profile fork 15 is spread by a device that is not represented, i.e., widened with respect to the inside dimension LW, until pushing onto the manifold 4 is possible. After reaching the end position (stop), the legs of the profile fork are relieved by the device and thereby come to lie under pretensioning against the overlapping regions of the manifold 4. The pretensioning is in this case based on the chosen oversize or undersize. The pretensioning is within the elastic range of the material of the holder 8, i.e., preferably an aluminum extrusion alloy. Therefore no plastic deformation occurs during the spreading of the profile fork 15. The clamping fit achieved in this way has the effect that the holder is fixed on the manifold 4 for the subsequent brazing process. The brazing composition is preferably available as a plated layer, which is applied to both sides on the base of the manifold 4 and on the outer side of the cover. The brazing takes place by the so-called Nocolok process, i.e., an appropriate flux in a suitable form is applied prior to the brazing, in this case preferably also prior to the joining of the parts 8 and 4.

Figure 8:
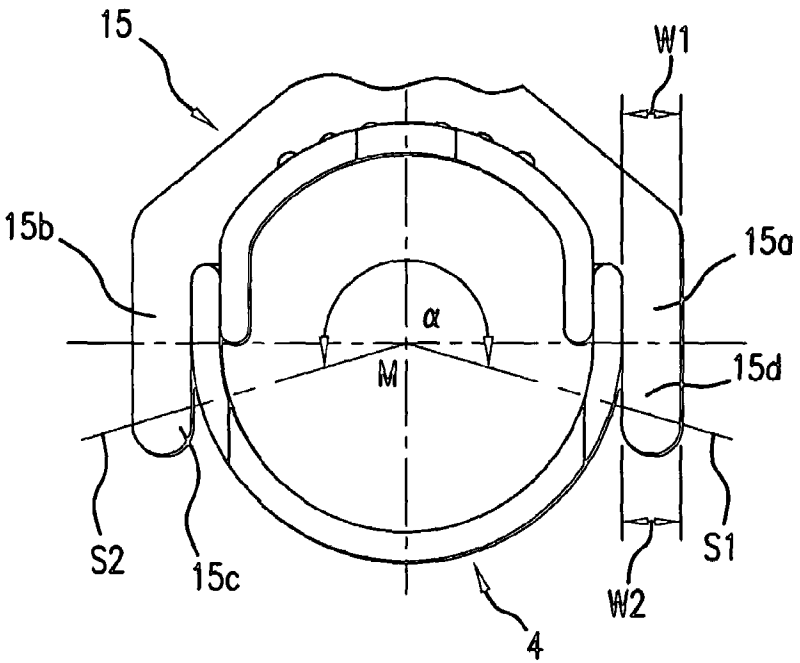
FIG. 8 is an enlarged representation of the connecting region between a holder or connector and a two-piece manifold.

FIG. 8 shows a detail from FIG. 6, i.e., an enlarged representation of the profile piece 15 with the manifold 4 in the joined state. In this representation, a circumferential angle α of a size of 210°, enclosed by lines s1, s2, is depicted, indicating one preferred circumferential range (sector) in which the profile piece 15 encloses the manifold 4. It can be seen that the legs 15*a*, 15*b* are extended beyond a diameter line m running through the center point M, i.e., beyond the lines s1, s2 of the circumferential angle α. In the region of the angle lines s1, s2, the legs 15*a*, 15*b* have an increased wall thickness w2 in comparison with a wall thickness w1 in the region of the center line m. Consequently, beneath the center line m, the legs 15*a*, 15*b* form bulging lips 15*c*, 15*d*, which grip behind the manifold 4 with a form locking, i.e., to prevent, or at least hinder, release of the clamping fit. The assembly of the fork-shaped profile piece 15 preferably takes place in the way described with respect to FIG. 7, i.e., by mechanical widening, subsequent joining and relieving of the profile fork to produce the clamping fit.

The foregoing description of preferred embodiments of the invention has been presented for purposes of illustration and description only. It is not intended to be exhaustive or to limit the invention to the precise form disclosed, and modifications and variations are possible and/or would be apparent in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto and that the claims encompass all embodiments of the invention, including the disclosed embodiments and their equivalents.

What is claimed is:

1. A heat exchanger suitable for use in a motor vehicle, consisting essentially of:

at least one generally cylindrical manifold; and at least one additional part fastened to the at least one manifold, the at least one additional part having a fork-shaped profile piece, which has a size and configuration with respect to the circumference of the manifold, such that the profile piece lies against the circumference of the manifold and can be fixed thereto by a form locking and frictional connection, wherein the profile piece comprises two legs, which have a size and configuration sufficient to lie with elastic pretensioning against the circumference of the manifold, wherein the profile piece encloses the manifold up to a circumferential angle α of at least 180°, wherein the profile piece forms a U-profile, comprising legs which include essentially straight intermediate portions that are arranged substantially parallel to each other, wherein the parallel running legs comprise distal converging arcuate pieces that form lips which grip behind the manifold with a form locking, and wherein the inner surfaces of the legs that engage the manifold are essentially smooth.

2. A heat exchanger as claimed in 1, wherein the manifold comprises a welded tube.

3. A heat exchanger as claimed in claim 1, wherein the manifold is formed of two pieces comprising a cover part and a base part.

4. A heat exchanger as claimed in claim 1, wherein the heat exchanger comprises a condenser of an air-conditioning system for a motor vehicle and has two manifolds.

5. A heat exchanger as claimed in claim 4, wherein the at least one additional part comprises at least one connector for connecting a refrigerant line.

6. A heat exchanger as claimed in claim 5, wherein the condenser further comprises at least one refrigerant connection pipe connecting between the refrigerant connector and the manifold.

7. A heat exchanger as claimed in claim 6, wherein the condenser is brazed to the at least one additional part and to the at least one connection pipe.

8. A heat exchanger as claimed in claim 7, wherein the brazing is conducted in a single brazing step.

9. A heat exchanger as claimed in claim 4, wherein the at least one additional part comprises a holder for mounting of the condenser in the vehicle.

10. A heat exchanger as claimed in claim 4, wherein the at least one additional part comprises an extruded part.

11. A motor vehicle comprising at least one heat exchanger, wherein the heat exchanger is a heat exchanger as claimed in claim 1.

12. A heat exchanger, suitable for use in a motor vehicle, comprising:

at least one generally cylindrical manifold; and at least one additional part fastened to the at least one manifold, the at least one additional part having a fork-shaped profile piece, which has a size and configuration with respect to the circumference of the manifold, such that the profile piece lies against the circumference of the manifold and can be fixed thereto by a form locking and frictional connection, wherein the profile piece comprises two legs, which have a size and configuration sufficient to lie with elastic pretensioning against the circumference of the manifold, wherein the profile piece encloses the manifold up to a circumferential angle $\alpha$ of at least 180°, wherein the profile piece forms a U-profile, comprising legs which are arranged substantially parallel to each other, wherein the parallel running legs comprise distal converging arcuate pieces that form lips which grip behind the manifold with a form locking, and wherein the inner surfaces of the legs that engage the manifold are essentially smooth, wherein the angle $\alpha$ is from about 200 to 210°.

13. A heat exchanger suitable for use in a motor vehicle, comprising:

at least one generally cylindrical manifold; and at least one additional part fastened to the at least one manifold, the at least one additional part having a fork-shaped profile piece, which has a size and configuration with respect to the circumference of the manifold, such that the profile piece lies against the circumference of the manifold and can be fixed thereto by a form locking and frictional connection, wherein the profile piece comprises two legs, which have a size and configuration sufficient to lie with elastic pretensioning against the circumference of the manifold, wherein the profile piece encloses the manifold up to a circumferential angle $\alpha$ of at least 180°, wherein the profile piece forms a U-profile, comprising legs which are arranged substantially parallel to each other and wherein the parallel running legs comprise distal converging arcuate pieces that form lips which grip behind the manifold with a form locking, wherein the manifold is formed of two pieces comprising a cover part and a base part, wherein the base part comprises two edges, running in the longitudinal direction, and the profile piece comprises inwardly directed offsets, which form stops with respect to the edges.

14. A method for mounting a heat exchanger in a motor vehicle, comprising:

applying to at least one substantially cylindrical manifold of a heat exchanger at least one mounting part that consists essentially of a fork-shaped profile piece, which has a size and configuration with respect to the circumference of the manifold, such that the profile piece lies against the circumference of the manifold and can be fixed thereto by a form locking and frictional connection, wherein the profile piece includes two legs, which have a size and configuration sufficient to lie with elastic pretensioning against the circumference of the manifold, wherein the profile piece encloses the manifold up to a circumferential angle $\alpha$ of at least 180°, wherein the profile piece forms a U-profile, comprising legs which include essentially straight intermediate portions that are arranged substantially parallel to each other, wherein the parallel running legs comprise distal converging arcuate pieces that form lips which grip behind the manifold with a form locking, and wherein the inner surfaces of the legs that engage the manifold are essentially smooth, to form a preliminary assembly; and subsequently subjecting the preliminary assembly to a brazing operation to braze together the at least one mounting part and the at least one manifold.

* * * * *